US009530305B2

(12) United States Patent
Burnette et al.

(10) Patent No.: US 9,530,305 B2
(45) Date of Patent: Dec. 27, 2016

(54) SYSTEM FOR OBTAINING PERFORMANCE INFORMATION

(75) Inventors: Stan Burnette, Colorado Springs, CO (US); Ken Fasen, Colorado Springs, CO (US)

(73) Assignee: UTC FIRE & SECURITY CORPORATION, Farmington, CT (US)

( * ) Notice: Subject to any disclaimer, the term of this patent is extended or adjusted under 35 U.S.C. 154(b) by 225 days.

(21) Appl. No.: 14/354,821

(22) PCT Filed: Oct. 28, 2011

(86) PCT No.: PCT/US2011/058401

§ 371 (c)(1),
(2), (4) Date: Apr. 28, 2014

(87) PCT Pub. No.: WO2013/062588

PCT Pub. Date: May 2, 2013

(65) Prior Publication Data

US 2014/0253318 A1 Sep. 11, 2014

(51) Int. Cl.

| | |
|---|---|
| ***G08B 23/00*** | (2006.01) |
| ***G08B 29/04*** | (2006.01) |
| ***G08B 29/14*** | (2006.01) |

(52) U.S. Cl.

CPC ..... *G08B 29/04* (2013.01); *G08B 29/14* (2013.01)

(58) Field of Classification Search

None

See application file for complete search history.

(56) References Cited

U.S. PATENT DOCUMENTS

| | | | | |
|---|---|---|---|---|
| 4,839,527 | A | 6/1989 | Leitch | |
| 5,686,885 | A | 11/1997 | Bergman | |
| 2004/0130445 | A1 | 7/2004 | Graves | |
| 2004/0217857 | A1 | 11/2004 | Lennartz et al. | |
| 2005/0073422 | A1* | 4/2005 | Graff | A47L 15/4293 340/641 |
| 2005/0190055 | A1 | 9/2005 | Petite | |

OTHER PUBLICATIONS

International Search Report Issued in PCT/US2011/058401, Jul. 31, 2012, 6 pages.

Written Opinion Issued in PCT/US2011/058401, Jul. 31, 2012, 4 pages.

* cited by examiner

*Primary Examiner* — Ojiako Nwugo

(74) *Attorney, Agent, or Firm* — Cantor Colburn LLP

(57) ABSTRACT

A system for obtaining performance information is provided and includes a condition detector configured to output the performance information as an optical signal, an optical probe wirelessly disposed in signal communication with the condition detector, the optical probe including a photodiode configured to receive the optical signal and to output an electrical signal accordingly, a data converter, which is coupled to the optical probe and configured to convert the electrical signal into data representative of the performance information and a computing device, which is coupled to the data converter and configured to allow for analysis, display and/or storage of the data representative of the performance information.

17 Claims, 3 Drawing Sheets

SYSTEM FOR OBTAINING PERFORMANCE INFORMATION

CROSS REFERENCE TO RELATED APPLICATION

This application is a National Stage of PCT Application No. PCT/US2011/058401 filed Oct. 28, 2011, the disclosure of which is incorporated by reference herein in its entirety.

BACKGROUND OF THE INVENTION

The subject matter disclosed herein relates to a system for obtaining performance information and, more particularly, to non-intrusively obtaining performance information from a condition detector.

When a smoke or carbon monoxide (CO) detector or alarm is installed in the field, it is often useful to be able to examine its operating history. This allows service personnel to gather performance data, diagnostic data or other data of other parameters for use in diagnosing problems. Data gathered can also be used for improving subsequent designs.

Previously, devices provided to allow service personnel to examine an operating history of a detector or an alarm in the field have been required to be electrically connected directly to the alarm and additionally required removal of the alarm from its mount as well as disassembly of its component parts. Processes for doing were often time consuming and complicated to perform.

BRIEF DESCRIPTION OF THE INVENTION

According to one aspect of the invention, a system for obtaining performance information is provided and includes a condition detector configured to output the performance information as an optical signal, an optical probe wirelessly disposed in signal communication with the condition detector, the optical probe including a photodiode configured to receive the optical signal and to output an electrical signal accordingly, a data converter, which is coupled to the optical probe and configured to convert the electrical signal into data representative of the performance information and a computing device, which is coupled to the data converter and configured to allow for analysis, display and/or storage of the data representative of the performance information.

According to another aspect of the invention, a condition detector to detect a condition and to issue an alarm in response to the detection is provided. The condition detector includes an optical element, a signal control unit coupled to the optical element and a microcontroller coupled to the signal control unit and configured to gather performance and/or diagnostic data and to transmit that performance and diagnostic data to the signal control unit. The signal control unit is configured to receive the performance and/or diagnostic data, to generate optical signals that are representative of the performance and/or diagnostic data and to cause the optical element to issue the optical signals.

According to yet another aspect of the invention, a method for obtaining performance information from a condition detector is provided and includes gathering data representative of performance information at the condition detector, issuing an optical signal reflective of the gathered data from the condition detector toward an optical probe and upon receipt of the optical signal at the optical probe, converting the optical signal into an electrical signal and converting the electrical signal into data representative of the performance information.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

In accordance with aspects of the invention, when a smoke or carbon monoxide detector or alarm ("condition detector" or "detector") is installed in the field, it is often useful to be able to examine its operating history without removing the detector from its mounting, electrically connecting an analysis device to it and/or disassembling any of its component parts. This allows service personnel to gather performance data, diagnostic data or other data of parameters for use in diagnosing problems. Data gathered can also be used for improving subsequent designs. During performance of the detector, performance and diagnostic data is saved to non-volatile memory contained within the detector's microcontroller. This data is then transmitted to a handheld or personal computer (PC) based device via the blinking of a light emitting diode (LED), which is generally installed on most if not all detectors. The data is encoded by the microcontroller and sent to the LED for transmission. The blinking of the LED is received by an optical device and converted into electrical signals that can be decoded into the original data and displayed or saved.

Figure 1:
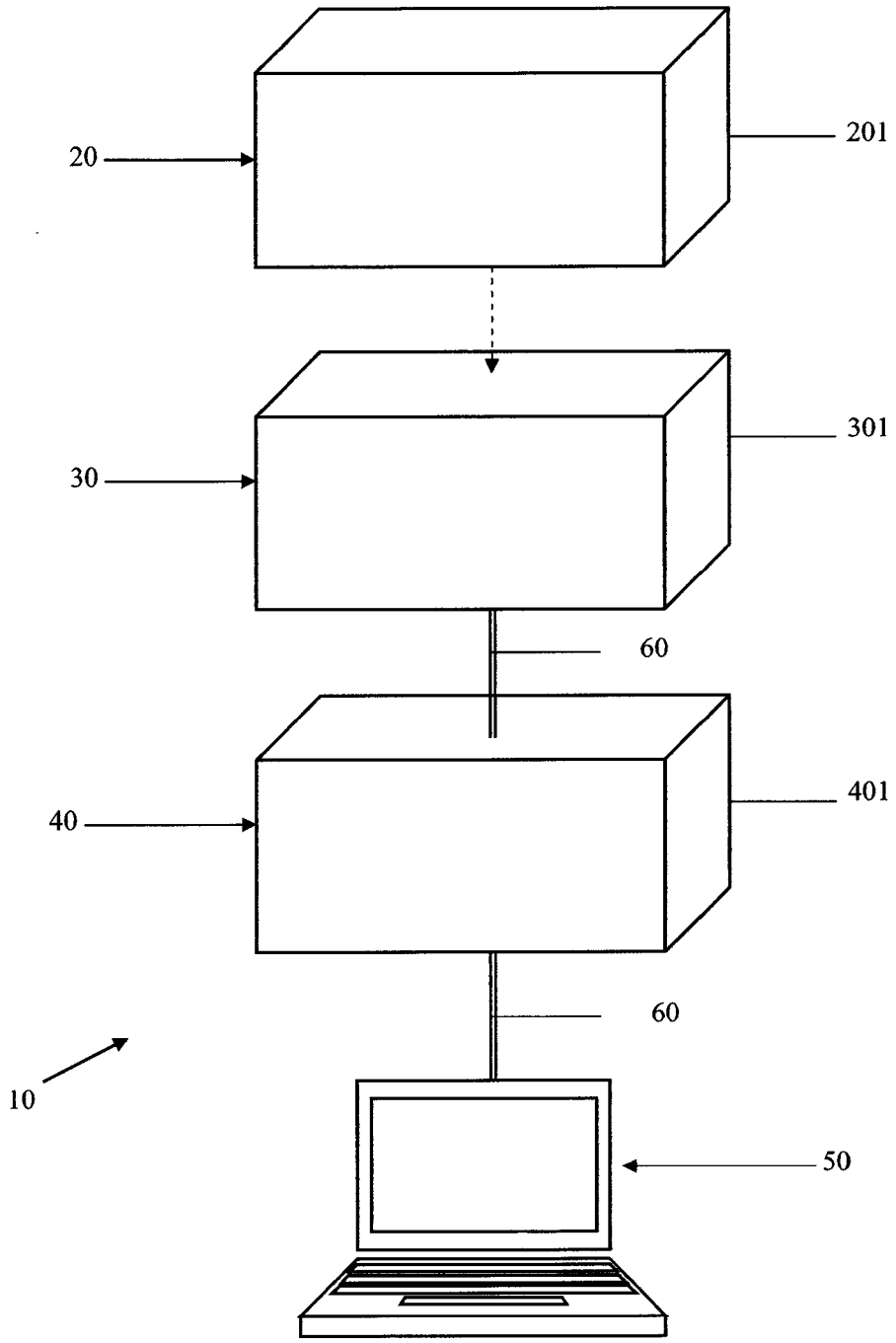
FIG. 1 is a schematic diagram of a system for executing a non-intrusive method of obtaining performance information from a condition detector.

With reference to FIG. 1, a system 10 is provided for executing a non-intrusive method of obtaining performance information from a condition detector 20. The system 10 includes the condition detector 20, which is modified as described herein and thereby configured to generate and issue optical signals as being representative of at least performance and/or diagnostic data (i.e., performance information). The system 10 further includes an optical probe 30, which is configured to detect the optical signals issued by the condition detector 20, a data converter 40, which is coupled to the optical probe 30 and configured to convert those optical signals into electrical signals representative of at least the performance and/or diagnostic data, and a portable, handheld or personal computing (PC) based device ("computing device") 50. The computing device 50 is coupled to the data converter 40 and configured to allow for analysis, display and/or storage of at least the performance and/or diagnostic data represented by the electrical signals.

Figure 2:
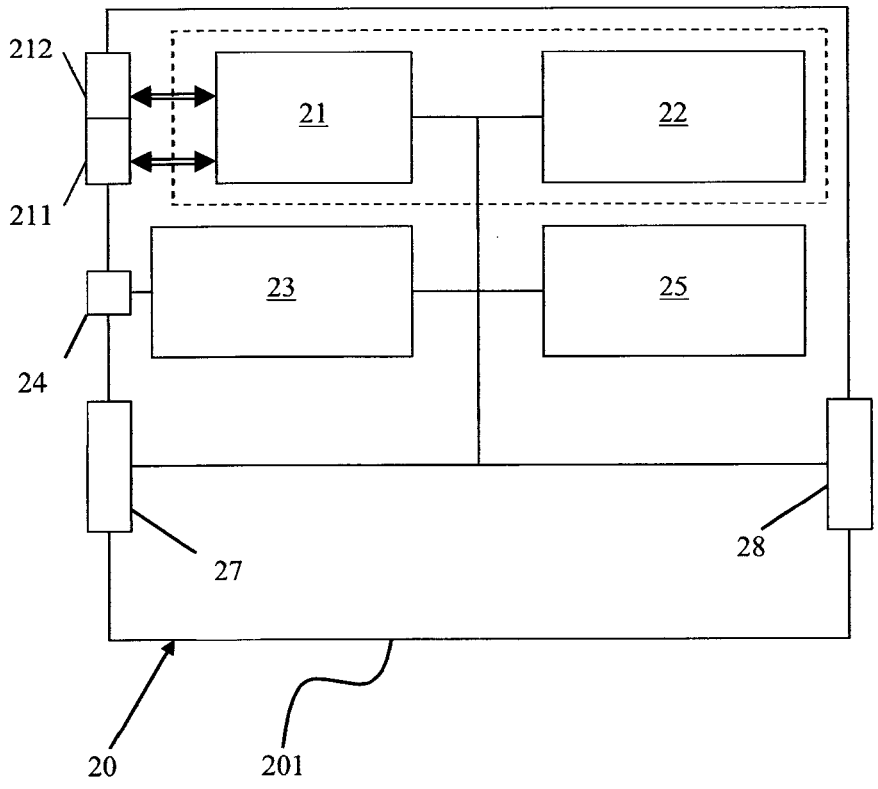
FIG. 2 is a schematic diagram of a condition detector of the system of FIG. 1 in accordance with embodiments.

With reference to FIG. 2, the condition detector 20 may be a smoke alarm, a fire alarm, a carbon monoxide (CO)

detector or another similar device. The condition detector 20 includes a housing 201, which can be mounted to a wall or a ceiling in a living/working space. In accordance with embodiments, the housing 201 of the condition detector 20 does not need to be removed from the mounting even when performance information is to be obtained from the condition detector 20.

The condition detector 20 further includes microcontroller 21, such as a central processing unit, a storage unit 22, such as volatile and/or non-volatile memory, a signal control unit 23, an optical element, such as a light bulb or a light emitting diode (LED) 24 and a power source 25, such as a battery. The microcontroller 21 is coupled to a condition detector sensor 211 and an alarm 212. The condition detector sensor 211 is configured to detect a condition in the proximity of the condition detector 20. In accordance with embodiments, the condition may include a hazardous condition, such as smoke, heat, fire, carbon monoxide, etc. The alarm 212 is configured to issue an alarm (i.e., an audible siren) when the condition is detected. The storage unit 22 may have executable instructions stored thereon, which, when executed, instruct at least the microcontroller 21 to operate as described herein. In accordance with embodiments, the microcontroller 21 may have integrated storage. In such cases, the storage unit 22 may not be needed/provided as a separate component.

The executable instructions instruct the microcontroller 21 to communicate with the condition detector sensor 211 and to operate the alarm 212 when the hazardous condition is detected. In addition, the executable instructions instruct the microcontroller 21 to gather performance and/or diagnostic data and to transmit that performance and diagnostic data to the signal control unit 23. The signal control unit 23 is configured to receive the performance and/or diagnostic data and to generate optical signals that are representative of the performance and/or diagnostic data. The signal control unit 23 is further configured to instruct or otherwise cause the LED 24 to issue the optical signals.

The optical signals can be issued by the LED 24 at predetermined times, periodically and/or in response to certain stimuli. For example, the microcontroller 21 may command the signal control unit 23 and the LED 24 to issue the optical signals at a given time of day, at a given time each day, repeatedly over the course of a given period of time or in response to an operator requesting that the optical signals be sent. The operator may do so by actuating the operator button 27 disposed on the condition detector 20 in a predetermined pattern or by simply being proximate to the condition detector 20 with the optical probe 30, the data converter 40 and/or the computing device 50. In the latter case, the condition detector 20 may further include in an optional embodiment a sensor 28, which is configured to sense and thereby determine that an operator is nearby and that the optical signals can be sent to an appropriate receiving device, such as the optical probe 30. In any case, the housing 201 need not be dismounted for the issuance of the optical signals to be conducted or received.

Figure 3:
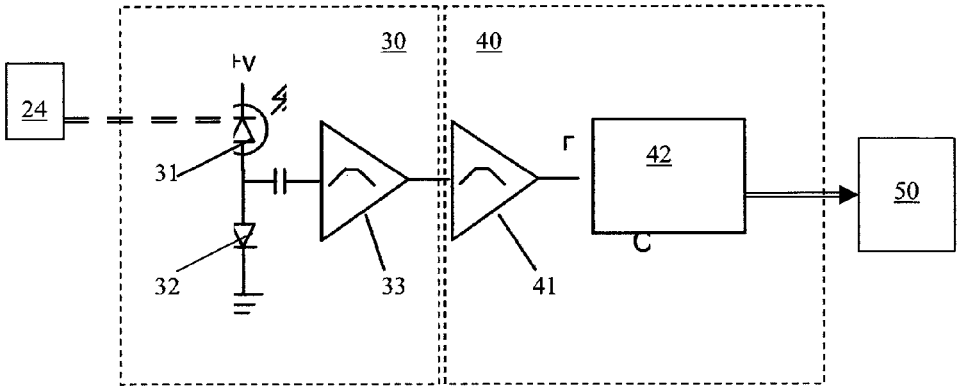
FIG. 3 is a schematic circuit diagram of an optical probe and a data converter of the system of FIG. 1 in accordance with embodiments.

With reference to FIG. 3, a schematic circuit diagram of the optical probe 30 and the data converter 40 are illustrated in accordance with embodiments. As shown, the optical probe 30 includes a photodiode 31, such as a 540 nm photodiode, disposed at a positive voltage, which is coupled to the ground via a silicon diode 32. The photodiode 31 is configured to output an electrical signal upon reception of an optical signal, such as the optical signal issued by the LED 24 of the condition detector 20. The optical probe 30 further includes at least one amplifier 33, which is coupled to the photodiode 31. The output electrical signal is thereby transmitted from the photodiode 31 to the at least one amplifier 33, which is configured to amplify the electrical signal such that it can be format converted.

Where the optical probe 30 includes more than one amplifier 33, the amplifiers 33 may be disposed in series electrically downstream from the photodiode 31. As shown in FIG. 3, however, it may be seen that the optical probe 30 includes a single amplifier 33 and that the data converter 40 includes a single amplifier 41. In either case, the amplifiers 33 and 41 are disposed in series electrically downstream from the photodiode 31 and together may generate an electrical signal from about 0-5 volts or, in some cases, 0-3 volts to an electrical signal required for various universal serial bus (USB) connections in the data converter 40 and/or the computing device 50. In accordance with further embodiments, it is to be understood that USB connections are not required and that there are other ways in which the data converter 40 can communicate with the computing device 50. These include, but are not limited to, recommended standard 232 telecommunications (RS232), recommended standard 485 (RS485) telecommunications, etc.

The data converter 40 thus may include the amplifier 41 and a format conversion unit 42. The format conversion unit 42 is disposed electrically downstream from the amplifier 41 and is configured to receive the amplified electrical signals originally output from the photodiode 31. The format conversion unit 42 is further configured to convert the amplified electrical signals into data, which is representative of the performance and/or diagnostic data gathered by the microcontroller 21 of the condition detector 20. The computing device 50 is disposed at least in signal communication with the data converter 40 and is therefore disposed to be receptive of the data representative of the performance and/or diagnostic data as generated by the format conversion unit 42.

The computing device 50 may be provided with a customized software application that allows an operator to analyze, display and/or store at least the performance and/or diagnostic data represented by the electrical signals. In accordance with embodiments, the customized software application may be configured to decode a data preamble that indicates the start of the performance and/or diagnostic data, to collect the data as data blocks sent by the LED 24, to input each block into the custom software application to be displayed and to organize the data and possibly export the data to a spreadsheet to be manipulated if desired.

In accordance with embodiments, the optical probe 30 and the data converter 40 may be provided in multiple housings 301 and 401, respectively, as multiple units or in a single housing as a single unit where the multiple housings 301 and 401 are formed together. Similarly, the optical probe 30, the data converter 40 and the computing device 50 may be provided separately from one another or as another single unit. In any case, the optical probe 30 is wirelessly disposed in signal communication or otherwise coupled to the condition detector 20 while the optical probe 30, the data converter 40 and the computing device 50 may be wired or wirelessly coupled to one another via exemplary wiring 60.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A system for obtaining performance information, the system comprising:

a building interior wall or ceiling mounted hazardous condition detector, which is provided as a battery powered smoke and/or carbon monoxide detector and which is configured to output the performance information as an optical signal;

an optical probe wirelessly disposed in signal communication with the condition detector, the optical probe including a photodiode configured to wirelessly receive the optical signal via wireless communication and to output an electrical signal accordingly;

a data converter, which is coupled to the optical probe and configured to convert the electrical signal into data representative of the performance information; and a computing device, which is coupled to the data converter and configured to allow for analysis, display and/or storage of the data representative of the performance information, the wireless communications being defined between respective housings of the condition detector and the optical probe, with the condition detector housing mounted on the building interior wall or ceiling and the optical probe being provided in a single unit with the data converter and the computing device.

2. The system according to claim 1, wherein the condition detector comprises a light emitting diode configured to issue the optical signal.

3. The system according to claim 1, wherein the optical probe comprises a 540 nm photodiode.

4. The system according to claim 1, wherein the optical probe and the data converter comprise amplifiers disposed in series to amplify the electrical signal output by the photodiode.

5. The system according to claim 1, further comprising a data converter housing to house the data converter.

6. The system according to claim 1, further comprising wiring by which the optical probe, the data converter and the computing device are coupled.

7. The system according to claim 1, wherein the condition detector comprises a sensor and outputs the optical signal responsive to the sensor sensing an operator.

8. A condition detector system to detect a condition and to issue an alarm in response to the detection, the condition detector system comprising:

a hazardous condition detection sensor configured to detect a hazardous condition;

an alarm configured to issue an alarm when the hazardous condition is detected;

an optical element;

a signal control unit coupled to the optical element;

a microcontroller coupled to the signal control unit and configured to gather performance and/or diagnostic data and to transmit that performance and diagnostic data to the signal control unit, the signal control unit being configured to receive the performance and/or diagnostic data, to generate optical signals that are representative of the performance and/or diagnostic data and to cause the optical element to issue the optical signals;

a building interior wall or ceiling mounted condition detector housing to house the hazardous condition detector sensor, the alarm, the optical element, the signal control unit and the microcontroller; and an optical probe comprising an optical probe housing and being configured for wireless receipt of the optical signals via wireless communication defined between the condition detector housing and the optical probe housing, with the condition detector housing mounted on the interior building wall or ceiling.

9. The condition detector system according to claim 8, wherein the condition detector housing is not dismounted for issuance of the optical signals.

10. The condition detector system according to claim 8, wherein the optical element comprises a light emitting diode (LED).

11. The condition detector system according to claim 8, wherein the optical signals are issued by the optical element at predetermined times, periodically and/or responsive to stimuli.

12. The condition detector system according to claim 8, wherein the condition detector housing houses a sensor and the optical signals are issued by the optical element responsive to the sensor sensing an operator.

13. A method for obtaining performance information from a condition detector comprising a hazardous condition detector sensor configured to detect a hazardous condition, an alarm configured to issue an alarm when the hazardous condition is detected and a building interior wall or ceiling mounted condition detector housing to house the hazardous condition detector sensors and the alarm, the method comprising:

gathering data representative of performance information at the condition detector;

issuing an optical signal reflective of the gathered data from the condition detector toward an optical probe comprising an optical probe housing; and upon receipt of the optical signal at the optical probe via wireless communication defined between the condition detector housing and the optical probe housing, with the condition detector housing mounted on the building interior wall or ceiling, converting the optical signal into an electrical signal and converting the electrical signal into data representative of the performance information.

14. The method according to claim 13, wherein the issuing comprises issuing the optical signal at a predetermined time, periodically or in response to stimuli.

15. The method according to claim 13, further comprising amplifying the electrical signal prior to the conversion of the electrical signal into the data representative of the performance information.

16. The method according to claim 13, further comprising analyzing, displaying and/or storing the data representative of the performance information.

17. The method according to claim 13, wherein the issuing comprises sensing an operator and issuing the optical signal responsive to the sensing of the operator.

* * * * *